United States Patent [19]

Kollock et al.

[11] Patent Number: 4,472,148

[45] Date of Patent: Sep. 18, 1984

[54] TILT MECHANISM FOR OUTBOARD MOTORS

[75] Inventors: Mark A. Kollock, Oshkosh; James M. Schiek, Omro, both of Wis.

[73] Assignee: Brunswick Corporation, Skokie, Ill.

[21] Appl. No.: 399,540

[22] Filed: Jul. 19, 1982

[51] Int. Cl.[3] ..... B63H 1/14

[52] U.S. Cl. ..... 440/53

[58] Field of Search ..... 440/53, 55, 56–65, 440/900

[56] References Cited

U.S. PATENT DOCUMENTS 4,013,249 3/1977 Meyer et al. ..... 440/900

4,331,430 5/1982 Lutzke et al. ..... 440/53

*Primary Examiner*—Trygve M. Blix

*Assistant Examiner*—Jesûs D. Sotelo

*Attorney, Agent, or Firm*—O. T. Sessions

[57] ABSTRACT

The tilt mechanism (10) for a marine propulsion unit has a swivel bracket (14) pivotally attached to a transom bracket (11). A trim pin (20) is carried by a trim pin carrier (24) which is pivotally attached to the swivel bracket (14). The trim pin (20) travels in cam slots (19) which define two connected cam loops and acts as a ratchet with notches (21, 22, 23) in the cam slots (19) to establish trim and tilt positions for the propulsion unit. The two cam loops allow the propulsion unit to be returned to the uppermost position without dropping to the lowest position first. A moveable return cam (38) in the lower loop allows the operator to select the lowest trim position to which the unit will return.

13 Claims, 7 Drawing Figures

TILT MECHANISM FOR OUTBOARD MOTORS

DESCRIPTION

This invention relates to outboard motors and particularly to a mechanism for providing a variety of tilt positions therefor.

BACKGROUND ART

A tilt mechanism for an outboard motor, described in U.S. Pat. No. 4,331,430 to Lutzke and Schiek has a ratchet like mechanism allowing the propulsion unit to be adjusted to a desired trim position by raising the propulsion unit to the desired trim position and releasing it. When the unit is tilted beyond the highest tilt position, the ratchet mechanism engages a return cam surface to allow the unit to be automatically returned to its lowest position. A lever is attached to the ratchet mechanism to allow the operator to disengage the ratchet and lower the unit without tilting to the highest position. Once the unit has been tilted beyond the highest tilt position and the ratchet mechanism engages the return cam surface, the unit must be returned to the lowest tilt position before the ratchet mechanism can engage the tilt position notches.

DISCLOSURE OF INVENTION

The invention provides a tilt mechanism for a marine propulsion device such as an outboard motor having a transom bracket and a swivel bracket pivotally connected to the transom bracket to provide tilting movement about a first generally horizontal axis. The transom bracket has a closed circuit cam track which includes a plurality of notches circumferentially spaced about the first horizontal axis and a return cam. A pawl assembly is pivotally attached on one end to the swivel bracket to rotate about a second generally horizontal axis. A biasing means biases a second end of the pawl assembly to engage the cam track and act as a ratchet with the cam track notches to provide a series of trim positions for the propulsion device. The pawl assembly further acts with the return cam surface to allow the automatic return of the swivel bracket from the uppermost trim position to a lower trim position. The tilt mechanism may have the return cam formed to allow the automatic return of the swivel bracket from both the uppermost and an intermediate trim position to a lower position and permit the swivel bracket to be raised to its uppermost position without returning to one of the lower positions. Either alternately or in addition to the automatic return feature, the trim mechanism may have an adjustably mounted return cam to allow the automatic return of the swivel bracket from an upper trim position to a preselected lower trim position. The tilt mechanism according to the invention thus allows the operator to return the propulsion unit to its full tilt position after it has been partially lowered thus avoiding the necessity for lowering the unit to one of its lower tilt positions, a maneuver which may be extremely difficult in some situations, for instance, if the boat has been beached. The tilt mechanism of the invention also allows the operator to preset the lower tilt or trim position to which the propulsion unit will return as it is lowered, thus avoiding the necessity for the operator to actively select the desired trim position each time the propulsion unit is tilted.

The cam track can conveniently be oriented in a plane perpendicular to the tilt axis and have a first step between the uppermost of the tilt position notches and the return cam surface and a second step between an intermediate one of the notches and both the return cam surface and the uppermost notch. The pawl assembly can include a trim pin carrier pivotally attached at one end to the swivel bracket and carrying a trim pin on its other end, with the trim pin extending generally parallel to the tilt axis to engage the cam track. The trim pin is axially biased by a cam spring toward the first and second steps to shift the pawl assembly from following the ratchet notches to following the return cam as the trim pin crosses the steps.

The length required for the adjustable return cam to provide a range of preselected trim positions can be kept to a minimum by pivotally mounting the return cam in one of a series of mounting holes to allow the cam surface to be in close proximity to the preselected tilt notch as the pawl assembly returns to the preselected notch and to rotate to let the pawl assembly pass as the propulsion unit is subsequently raised.

BEST MODE FOR CARRYING OUT THE INVENTION

Figure 1:
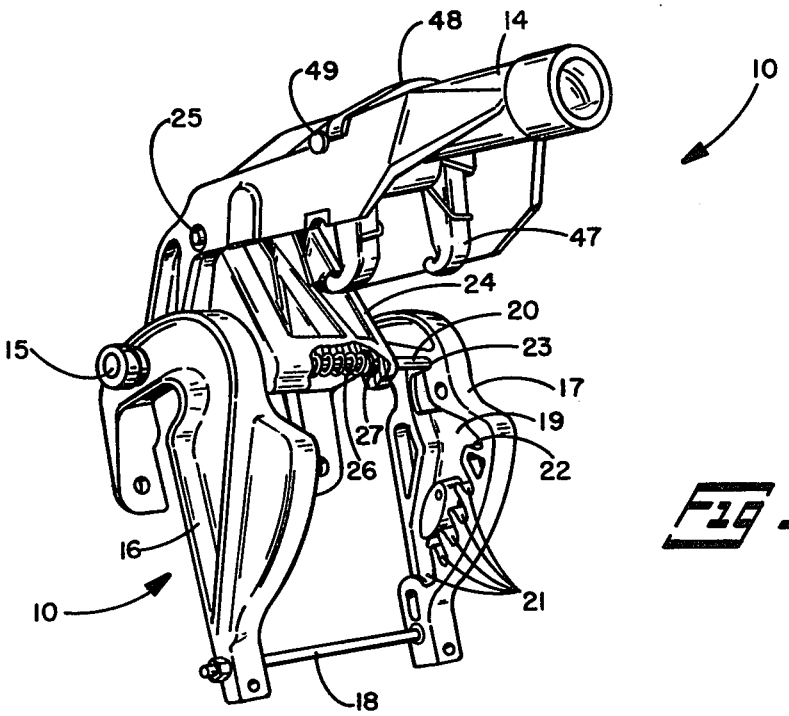
FIG. 1 is a perspective view of a tilt mechanism according to the invention.

The tilt mechanism 10 shown in the figures includes a transom bracket assembly having screw clamps 12 for attachment to the transom 13 of a boat. A swivel bracket 14, mounted on the transom bracket assembly by a pivot tube 15, provides tilting movement about the generally horizontal axis of the pivot tube 15. An outboard drive unit, not illustrated, is mounted on the swivel bracket 14 in a conventional manner to provide steering about a generally vertical steering axis.

The transom bracket assembly includes port and starboard clamping members 16 and 17 held together in a spaced relationship by the pivot tube 15 and a tubular cross-member 18. The clamping members 16 and 17 have corresponding oppositely facing cam slots 19 formed to receive the ends of a trim pin 20 and hold the trim pin 20 in a variety of positions. The slots 19 in the clamping members 16 and 17 each have corresponding notches including a range of trim position notches 21, a shallow water drive notch 22, and an elevated tilt position notch 23 to provide a range of angular positions for the trim pin 20.

The trim pin 20 is carried in the clamping member slots 19 by a trim pin carrier 24 which is pivotally attached to the swivel bracket 14 by a rod 25 mounted in bores in the swivel bracket 14 and the trim pin carrier 24. The trim pin 20 is mounted in holes through the lower end of the trim pin carrier 24 and is axially biased toward the starboard clamping member 17 by a coil spring 26. The coil spring 26 is compressed between one arm of the trim pin carrier 24 and a collar 27 on the trim pin 20. The trim pin carrier 24 is biased in the sternward direction by a torsional pawl spring 28 supported on the pivot rod 25. The pawl spring 28 includes a center portion 29 abutting against the center flange of the swivel bracket 14 and two legs 30, each having a spiral portion 31 wrapped around the pivot rod 25 and a hooked end engaging a flange on the trim pin carrier 24. The pawl spring 28 thus biases the trim pin carrier 24 sternward to force the trim pin 20 into contact with the sternward surfaces of the clamping member cam slots 19.

Figure 3:
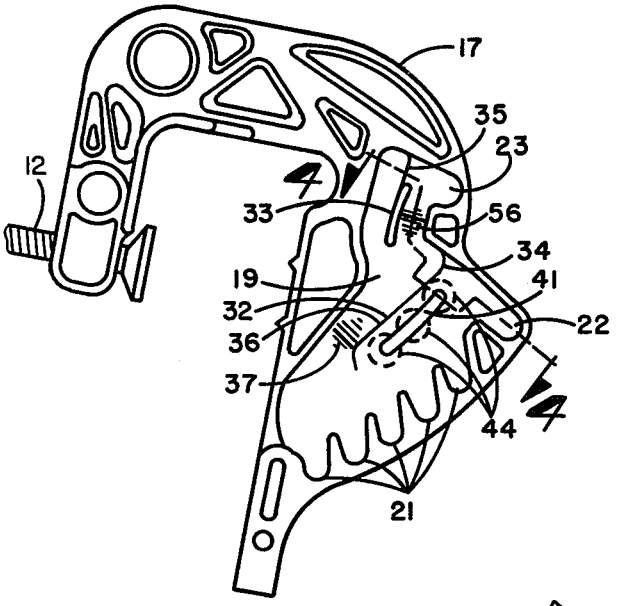
FIG. 3 is a side view of the starboard clamp bracket incorporated in the tilt mechanism of FIG. 1.
Figure 4:
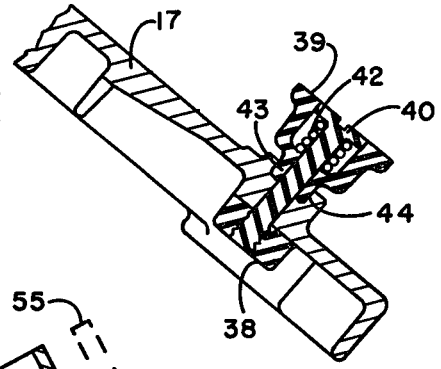
FIG. 4 is an enlarged sectional view taken along line 4—4 of FIG. 3.

The cam slots 19 in each of the clamping members 16 and 17 form two connected cam loops. The lower loop includes the trim position notches 21, the shallow water drive notch 22 and a first return cam surface 32, while the upper loop includes the tilt position notch 23 and a second return cam surface 33. As most clearly shown in FIGS. 3 and 4, a first step 34 is formed in the bottom of the groove 19 of the starboard clamping member 17 between the shallow water drive notch 22 and the tilt position notch 23 and a second step 35 is formed between the tilt position notch 23 and the second return cam surface 33. The first step 34 allows the trim pin 20 to shift axially when it is raised past the step to ride on the first return cam surface 32, while the second step 35 allows the trim pin 20 to shift axially to ride on the second return cam surface 33.

In the lower cam loop the upper portion of the return cam surface 32 is provided by a fixed cam surface 36 formed as part of the clamping member 17. The fixed cam surface 36 extends from the first axial step 34 downward to a position allowing the trim pin carrier 24 to return the trim pin 20 to the middle one of the trim position notches 21. A ramp 37 in the bottom of the cam groove 19 along the fixed return cam surface 36 returns the trim pin 20 to an axial position corresponding to the top of the first axial step 34 as the trim pin 20 follows the fixed return cam surface 36.

To allow operator selection of the lowest trim position to which the trim pin 20 returns, a moveable return cam 38 is provided. A knob 39 is attached to the moveable cam 38 by a screw 40 extending through a slot 41 in the starboard clamping member 17. The knob 39 is biased toward the clamping member 17 by a coil spring 42 supported on the screw 40 between the screw head and the knob 39. An annular projection 43 on the knob 39 is formed to engage one of the three holes 44 formed along the slot 41 on the outside of the clamping member 17. The moveable cam 38 can thus be positioned and retained in one of three positions corresponding to the three holes 44 while remaining free to rotate about the axis of the screw 40.

Figure 5:
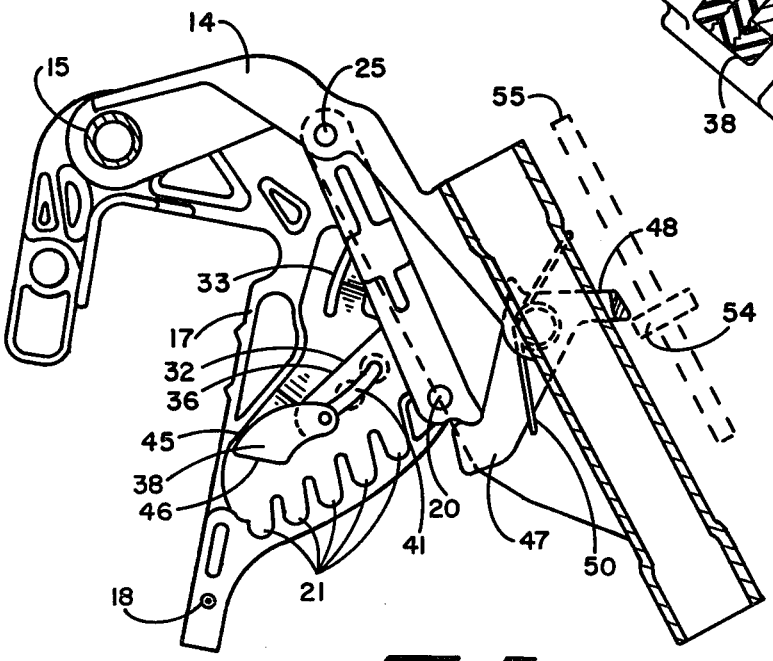
FIGS. 5, 6 and 7 are schematic side views of the mechanism of FIG. 1 showing various tilt positions.

The moveable cam 38 includes a return cam surface 45 for guiding the trim pin 20 to a preselected trim position notch and lower cam surface 46 to allow the trim pin 20 to rotate the moveable cam 38 upward to allow the trim pin 20 to pass beneath. With the moveable cam 38 positioned as shown in FIG. 5, the trim pin 20 can move downward along the fixed cam surface 36, engage the upper cam surface 45 of the moveable cam 38 rotating it downward until the lower cam surface 46 engages the upper end of the trim position notches 21. The trim pin 20 can then continue to move down along the return cam surface 45 until the trim pin 20 drops into the selected trim position notch. Subsequently, raising the swivel bracket 14 will lift the trim pin 20 out of the trim position notch 21 and rotate the moveable cam 38 upward to allow the trim pin 20 to pass.

Figure 2:
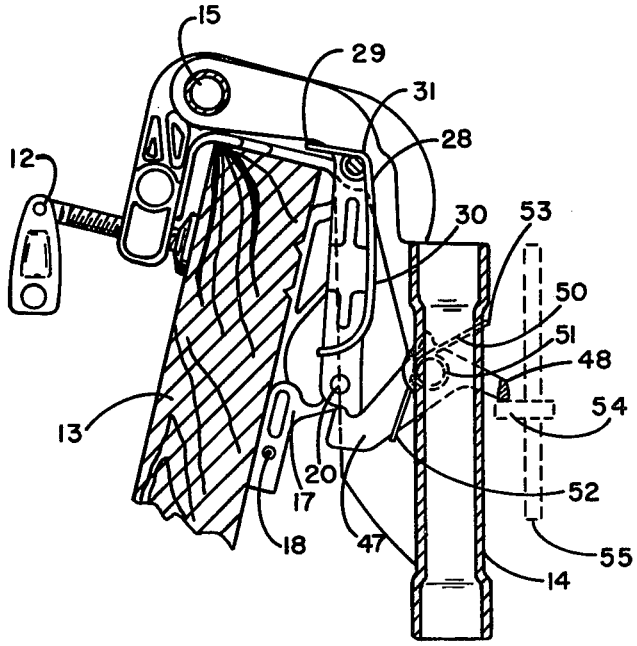
FIG. 2 is a side-elevational view in section of the tilt mechanism of FIG. 1 showing a lower trim position.

A pair of reverse hooks 47 mounted on the swivel bracket 14 prevent tilting of the swivel bracket 14 and outboard drive unit when the unit is in any of the trim positions or the shallow water drive position and is shifted into reverse gear. A connecting U-shaped member 48 is formed integrally with the two hooks 47 and a projection 49 is formed on each side of the U to provide a bearing. The hooks 47 extend through holes on each side of the swivel bracket 14 with the bearing projection 49 riding in semi-circular notches on each side of the swivel bracket 14. A spring 50 having two coils 51, one wrapped about each of the bearing projections 49, two legs 52 engaging the reverse hooks 47 and a bridging portion 53 connecting the two coils 51 and abutting against the swivel bracket 14 serves to bias the reverse hooks 47 to rotate clockwise as viewed in the Figures and also holds the hooks 47 in position on the swivel bracket 14. The reverse hooks 47 thus engage the lower end of the trim pin carrier 24 when the trim pin 20 is in any of the trim pin notches or the shallow water drive notch 22, as shown in FIGS. 2 and 5. A projection 54 on the shift linkage 55 of the outboard drive unit is positioned to engage the U-shaped portion 48 of the reverse hook assembly to prevent it from engaging the trim pin carrier 24 when the drive unit transmission is in forward gear. The projection 54 can be positioned to provide reverse locking in neutral, if desired.

OPERATION

The invention provides a single mechanism allowing the operator to adjust the trim or tilt position of an outboard drive unit by simply moving the drive unit. With the unit positioned as shown in FIG. 2 and the shift linkage 55 in the neutral or forward position to disengage the reverse hooks 47, the unit may be tilted upward to the desired trim angle and released. The trim pin carrier 24 and trim pin 20 will act as a ratchet with the trim position notches 21 or the shallow water drive notch 22 and support the drive unit at the desired angle with the swivel bracket 14 resting against the trim pin 20 to carry the forward thrust loads as shown in FIGS. 2 and 5.

Tilting the drive unit beyond the shallow water drive position shown in FIG. 5 will bring the trim pin 20 past the first axial step 34 causing the spring biased trim pin 20 to shift axially, whereupon the trim pin 20 will either follow the first return cam surface 32 if the unit is then lowered or follow the cam slot 19 upward to the full tilt notch 23 if the drive unit is raised further.

Figure 6:
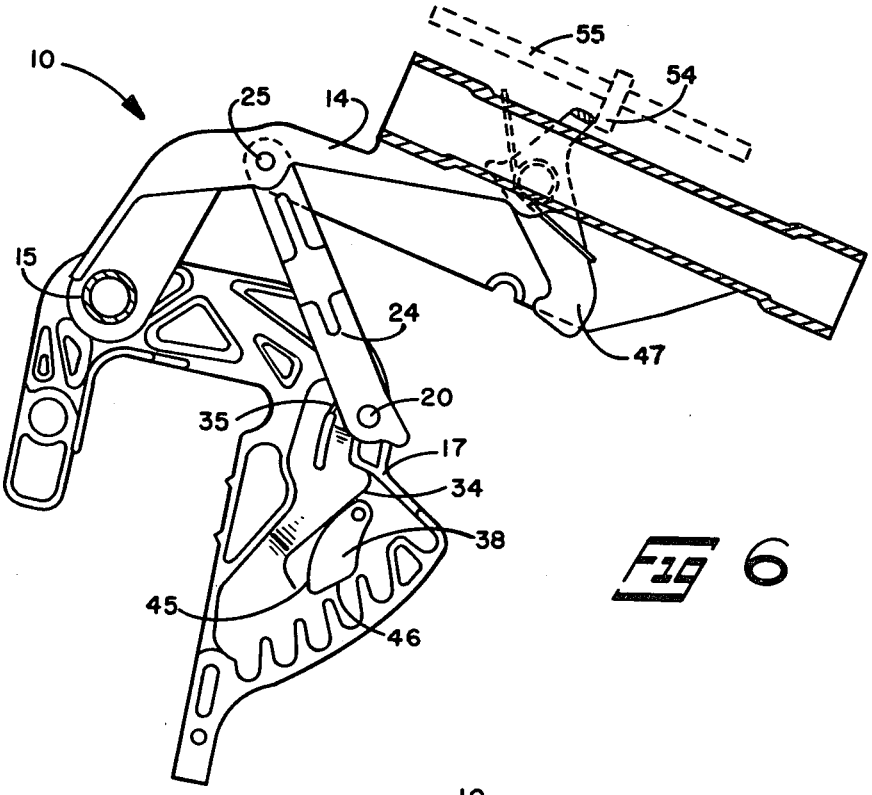

Assuming the propulsion unit is tilted up beyond the first axial step 34, a ramp 56 in the bottom of the cam groove 19 will shift the trim pin 20 axially back to the level corresponding with the top of the first step 34 when the trim pin 20 reaches the full tilt notch 23. With the trim pin 20 in the full tilt notch 23 the propulsion unit will be supported by the trim pin carrier 24, as shown in FIGS. 1 and 6.

Tilting the propulsion unit further will bring the trim pin 20 past the second axial step 35, causing the trim pin 20 again to shift axially, preventing the trim pin 20 from returning across the step. Once past the second step 35, the propulsion unit can only be lowered until the bottom of the second or upper return cam surface 33 is reached. From the bottom of the upper return cam surface 33 the trim pin 20 will shift to the first or lower return cam surface 32 as the propulsion unit is lowered. At this point, the unit can either be tilted back up to the full tilt position or lowered further to the preselected lower trim position.

Figure 7:
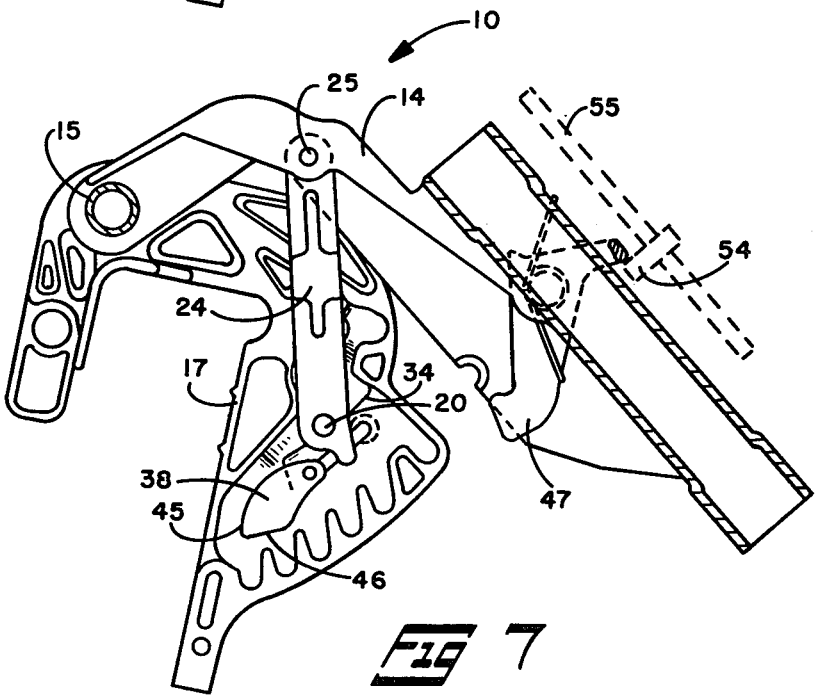

If the adjustable cam 38 has been positioned in its lowest position as illustrated in FIG. 7, the trim pin 20 will follow the lower return cam surface 32 as the drive unit is lowered. Upon reaching the moveable cam 38, the trim pin 20 will follow the return cam surface 45 of the moveable cam 38 until it reaches the lowest trim position notch, in the process rotating the moveable cam 38 until its lower surface 46 contacts the upper portions of the trim position notches 21. Of course, if the moveable cam 38 has been positioned by the operator in the middle or upper position the trim pin 20 will return to the corresponding second or third trim position notch.

The invention thus provides a tilt mechanism which may easily be manipulated by the operator to support the drive unit at the desired angle.

We claim:

1. A tilt mechanism for a marine propulsion device comprising:

(A) a transom bracket for attachment to a boat, said transom bracket having a closed circuit cam track including:

(i) a plurality of notches circumferentially spaced about a first generally horizontal axis, and (ii) a return cam means having an upper return cam surface and a lower return cam surface, said upper and lower surfaces and said notches defining interconnected upper and lower cam loops;

(B) a swivel bracket pivotally connected to said transom bracket for pivotal movement about said first horizontal axis;

(C) a pawl assembly having one end pivotally attached to said swivel bracket for rotation about a second generally horizontal axis, said pawl assembly having a second end and a biasing means for biasing said second end to engage said cam track, said pawl assembly acting as a ratchet with said plurality of notches to provide a series of angular positions for said propulsion device, and further acting as a cam follower with said return cam surfaces to allow the automatic return of said swivel bracket from an uppermost position to a lower position, from an intermediate position directly to a lower position, and to permit said swivel bracket to be raised to the uppermost position without returning to one of the lower positions.

2. The tilt mechanism defined in claim 1 wherein said return cam means includes an adjustable cam adjustably mounted on said transom bracket to allow the automatic return of said swivel bracket from either said uppermost or said intermediate position to a pre-selected lower position.

3. The tilt mechanism defined in claim 1 or 2 wherein said closed circuit cam track lies in a plane generally perpendicular to said first and second axes and comprises a first step between an uppermost one of said notches and the upper return cam surface of said return cam means and a second step between an intermediate one of said notches and both said lower return cam surface and said uppermost notch.

4. The tilt mechanism defined in claim 3 wherein said pawl assembly includes a trim pin carrier having a first end pivotally attached to said swivel bracket and a trim pin attached to a second end of said trim pin carrier, said trim pin having an end extending generally parallel to said first and second axes to engage said cam track.

5. The tilt mechanism defined in claim 4 wherein said biasing means comprises a cam spring to axially bias said trim pin end toward said steps.

6. The tilt mechanism defined in claim 5 wherein said biasing means further comprises a pawl spring to bias said trim pin carrier toward said swivel bracket and said notches.

7. The tilt mechanism defined in claim 6 wherein said notches comprise a first series of notches positioned to enable said swivel bracket to rest against said trim pin when said trim pin is engaged with a notch of said first series of notches.

8. The tilt mechanism defined in claim 7 wherein at least said uppermost one of said notches is positioned to enable said trim pin carrier to support said swivel bracket when said trim pin is engaged with said uppermost notch.

9. A tilt mechanism for a marine propulsion device comprising:

(A) a transom bracket for attachment to a boat, said transom bracket having a closed circuit cam track including a plurality of notches circumferentially spaced about a first generally horizontal axis;

(B) an adjustable return cam adjustably mounted on said transom bracket, said return cam having a return cam surface;

(C) a swivel bracket pivotally connected to said transom bracket for pivotal movement about said first horizontal axis;

(D) a pawl assembly having one end pivotally attached to said swivel bracket for rotation about a second generally horizontal axis, said pawl assembly having a second end and a biasing means for biasing said second end to engage said cam track and said notches, said pawl assembly acting as a ratchet with said plurality of notches to provide a series of angular positions for said propulsion device, and further acting as a cam follower with said adjustable return cam to allow the automatic return of said swivel bracket from an uppermost position to a pre-selected lower position.

10. The tilt mechanism defined in claim 2 or 9 wherein said transom bracket includes a plurality of cam mounting holes and said return cam includes a projection for engaging a pre-selected one of said mounting holes.

11. The tilt mechanism defined in claim 10 wherein said return cam is pivotally mounted in said pre-selected mounting hole whereby the return cam surface of said cam will be in close proximity to a pre-selected one of said cam track notches as said pawl assembly returns to said pre-selected notch and said return cam is free to rotate to allow said pawl assembly to act as a ratchet.

12. The tilt mechanism defined in claim 11 wherein said return cam includes a spring loaded mounting stem extending through said cam mounting hole to releasably engage said return cam with any one of said mounting holes.

13. The tilt mechanism defined in claim 12 wherein said transom bracket includes a slot therethrough interconnecting said cam mounting holes whereby said return cam can be moved from one mounting hole to another without removal from said transom bracket.

* * * * *